US007622870B2

(12) United States Patent
Fukumoto et al.

(10) Patent No.: US 7,622,870 B2
(45) Date of Patent: Nov. 24, 2009

(54) INVERTER APPARATUS

(75) Inventors: Kenichi Fukumoto, Kyoto (JP); Goang-Woo Nam, Kyoto (JP)

(73) Assignee: Rohm Co., Ltd. (JP)

( * ) Notice: Subject to any disclaimer, the term of this patent is extended or adjusted under 35 U.S.C. 154(b) by 0 days.

(21) Appl. No.: 11/786,104

(22) Filed: Apr. 11, 2007

(65) Prior Publication Data

US 2007/0252535 A1 Nov. 1, 2007

(30) Foreign Application Priority Data

Apr. 13, 2006 (JP) ..... 2006-111210

(51) Int. Cl.
*H05B 37/02* (2006.01)

(52) U.S. Cl. ..... 315/291; 315/276; 315/307; 315/312

(58) Field of Classification Search ..... 315/209 R, 315/210–212, 219, 224–226, 246, 276, 291, 315/307–308, 312; 345/87, 102, 204
See application file for complete search history.

(56) References Cited

U.S. PATENT DOCUMENTS

| | | | | |
|---|---|---|---|---|
| 6,326,740 | B1 * | 12/2001 | Chang et al. | 315/291 |
| 2003/0090913 | A1 * | 5/2003 | Che-Chen et al. | 363/21.12 |
| 2003/0107332 | A1 * | 6/2003 | Newman et al. | 315/307 |
| 2005/0029967 | A1 * | 2/2005 | Chen et al. | 315/291 |
| 2006/0022612 | A1 * | 2/2006 | Henry | 315/276 |
| 2006/0061982 | A1 * | 3/2006 | Lee | 362/29 |
| 2006/0113926 | A1 * | 6/2006 | Lin | 315/291 |
| 2006/0197466 | A1 * | 9/2006 | Park | 315/224 |
| 2006/0238142 | A1 * | 10/2006 | Bai et al. | 315/291 |
| 2007/0040517 | A1 * | 2/2007 | Yu | 315/291 |

FOREIGN PATENT DOCUMENTS

| | | |
|---|---|---|
| JP | 8-335497 | 12/1996 |
| JP | 2002-134293 | 5/2002 |
| JP | 2003-323994 | 11/2003 |
| JP | 2004-335422 | 11/2004 |
| WO | WO 2005/038828 A2 | 4/2005 |

OTHER PUBLICATIONS

Chinese Office Action for Chinese Patent Application No. 200710096091.3 issued Oct. 31, 2008 with English Translation.
Chinese Office Action for Chinese Application No. 200710096091.3 issued May 8, 2009 with English translation.

* cited by examiner

*Primary Examiner*—David Hung Vu
*Assistant Examiner*—Tung X Le
(74) *Attorney, Agent, or Firm*—Cantor Colburn LLP

(57) ABSTRACT

A switching circuit includes a plurality of transistors connected to a primary winding of the transformer and alternately applies an input voltage and a ground voltage to the primary winding according to turning-on and turning-off of each of the transistors. A plurality of capacitors are provided to the respective fluorescent lamps. One ends of the capacitors are commonly connected to a secondary winding of the transformer, and the other ends thereof are connected to the respective fluorescent lamps. A control circuit monitors a current flowing through a predetermined current path among current paths of the entire circuits including an inverter and the fluorescent lamps and performs feedback control of the turning-on and turning-off states of a plurality of the transistors of the switching circuit to adjust supply of switching power to the primary winding of the transformer so that the monitored current can be maintained in a predetermined condition.

13 Claims, 4 Drawing Sheets

INVERTER APPARATUS

BACKGROUND OF THE INVENTION

1. Field of the Invention

The present invention relates to an inverter apparatus for converting a DC input voltage to an AC voltage and supplying the AC voltage to a load, and more particularly to, an inverter apparatus for driving a plurality of loads.

2. Description of the Related Art

Recently, as a substitute for CRT televisions, thin, wide screen liquid crystal televisions have been widely provided. As a backlight for the liquid crystal television, a plurality of cold cathode fluorescent lamps (hereinafter, referred to as CCFLs) or a plurality of external electrode fluorescent lamps (hereinafter, referred to as EEFLs) are disposed on a rear surface of a liquid crystal panel.

An inverter (DC/AC converter) which boosts up a DC voltage of about 12V and outputs an AC voltage is used for driving the fluorescent lamp such as the CCFL and the EEFL. The inverter converts a current flowing through the fluorescent lamp to a voltage and feed the voltage back to a control circuit, so that turning-on and turning-off of a switching element are controlled based on the feedback voltage. The related technologies are disclosed in Japanese Patent Application Laid-Open No. 2003-323994, International Publication Pamphlet No. 2005/038828, and Japanese Patent Application Laid-Open Nos. 2002-134293 and 2004-335422.

[Patent Document 1] Japanese Patent Application Laid-Open No. 2003-323994

[Patent Document 2] International Publication Pamphlet No. 2005/038828

[Patent Document 3] Japanese Patent Application Laid-Open No. 2002-134293

[Patent Document 4] Japanese Patent Application Laid-Open No. 2004-335422

Now, a case where a plurality of fluorescent lamps are driven by using an AC voltage boosted by an inverter is considered. Luminance of each fluorescent lamp is determined by a current flowing through each fluorescent lamp. In order to obtain uniform or desired different luminance of a plurality of the fluorescent lamps, the currents flowing through the fluorescent lamps need to be controlled.

However, in a case where the currents flowing through a plurality of the fluorescent lamps are individually controlled in a feedback manner, control circuits need to be provided to the respective fluorescent lamps. In applications such as a liquid crystal television or a liquid crystal monitor, several or tens of fluorescent lamps are lighted simultaneously. In this case, if a plurality of the control circuits are incorporated in the liquid crystal television, there are disadvantages in terms of mounting area, cost, and power consumption.

SUMMARY OF THE INVENTION

The present invention has been made in view of above problems. A general purpose of the present invention is to provide an inverter apparatus capable of driving a plurality of loads such as fluorescent lamps with a common control circuit.

According to an embodiment of the present invention, there is provided an inverter apparatus for converting an input voltage to an AC driving voltage and supplying the AC driving voltage to a plurality of loads. The inverter apparatus according to the embodiment includes: a transformer including a primary winding and a secondary winding; a switching circuit including a plurality of transistors connected to the primary winding of the transformer, the switching circuit alternately applying the input voltage and a fixed voltage lower than the input voltage to the primary winding of the transformer according to turning-on and turning-off of each of the transistors; a plurality of capacitors provided to the respective loads, one ends of the capacitors being commonly connected to the secondary winding of the transformer, and the other ends thereof being connected to the respective loads; and a control circuit which monitors a current flowing through a predetermined current path among current paths of the entire circuits including the inverter apparatus and the loads and performs feedback control of the turning-on and turning-off states of a plurality of the transistors of the switching circuit to adjust supply of switching power to the primary winding of the transformer so that the monitored current can be maintained in a predetermined condition.

In the embodiment, a plurality of the loads and a plurality of the capacitors connected in series thereto constitute a plurality of the current paths which are connected in parallel to each other. Since the same voltage is applied to a plurality of the current paths, a current corresponding to a composite impedance of each capacitor and each load flows through each current path. According to the embodiment, the currents flowing through a plurality of the loads can be directly or indirectly controlled by commonly providing the control circuit according to the capacitances of the capacitors.

In one embodiment, a plurality of the loads may be a plurality of fluorescent lamps. The fluorescent lamps may be cold cathode tube fluorescent lamps or external electrode fluorescent lamps. In this case, since a change or irregularity of the impedances of a plurality of the fluorescent lamps can be suitably removed, the currents flowing through a plurality of the current paths including the fluorescent lamps and the capacitors can be maintained in a stabilized state.

In one embodiment, capacitance values of a plurality of the capacitors may be set to be in a range of 1 pF to 100 pF. The capacitors having the capacitance values in the aforementioned range are inserted in series to the fluorescent lamps, so that the luminance of the fluorescent lamps can be stabilized.

In one embodiment, the capacitance values of a plurality of the capacitors may be set according to relative luminance among a plurality of the fluorescent lamps. Since the currents flowing through a plurality of the current paths including the fluorescent lamps and the capacitors depend on the impedances of the fluorescent lamps and the capacitors, the current flowing through each fluorescent lamp can be controlled by adjusting the capacitance values.

In one embodiment, at least a part of a plurality of the capacitors may be constructed using patterns formed on a printed circuit board where the inverter apparatus is mounted.

In one embodiment, the control circuit may monitor a current flowing through the current paths including a predetermined load among a plurality of the loads and control the turning-on and turning-off states of a plurality of the transistors of the switching circuit so that the current flowing through the predetermined load approaches a predetermined current value. In this case, the control circuit may include: a feedback circuit which is disposed on the current path including the predetermined load to generate a feedback signal indicating a voltage value corresponding to the current flowing through the predetermined load; a pulse modulator which receives the feedback signal from the feedback circuit and compares the feedback signal with a predetermined reference voltage to generate a pulse modulated signal; and a driver circuit which receives the pulse modulated signal from the pulse modulator and controls the turning-on and turning-off of a plurality of the transistors of the switching circuit based on the pulse modulated signal.

In this case, the feedback control can be performed directly so that a current flowing through a predetermined load can approach a predetermined current value, and the feedback control can be performed indirectly so that a current flowing through another load can be approach a predetermined current value.

In one embodiment, the control circuit may monitor a current flowing through a current path including the secondary winding of the transformer and control the turning-on and turning-off states of the transistors of the switching circuit so that the current flowing through the secondary winding of the transformer can approach a predetermined current value. In this case, the control circuit may include: a feedback circuit which is disposed on the current path including the secondary winding of the transformer to generate a feedback signal indicating a voltage value corresponding to the current flowing through the secondary winding of the transformer; a pulse modulator which receives the feedback signal from the feedback circuit and compares the feedback signal with a predetermined reference voltage to generate a pulse modulated signal; and a driver circuit which receives the pulse modulated signal from the pulse modulator and controls the turning-on and turning-off of a plurality of the transistors of the switching circuit based on the pulse modulated signal.

A total current flowing through a plurality of the loads flows through the secondary winding of the transformer, and the currents according to the composite impedances of the current paths including the loads are branched into the respective loads. Therefore, the current flowing through the secondary winding of the transformer is stabilized, so that the currents flowing through a plurality of the loads can be stabilized.

According to another embodiment of the present invention, there is provided a light emitting apparatus. The light emitting apparatus includes: a plurality of fluorescent lamps; and the inverter apparatus according to any of the aforementioned embodiments, which supplies AC driving voltages to a plurality of the fluorescent lamps that are the loads.

According to the embodiment, the luminance of a plurality of the fluorescent lamps can be commonly controlled by a control circuit.

According to a still another embodiment, there is provided an image display apparatus. The image display apparatus includes: a liquid crystal panel; and the aforementioned light emitting apparatus which is disposed as a backlight on a rear surface of the liquid crystal panel.

According to the embodiment, a plurality of the fluorescent lamps can be driven by a small control circuit, so that the image display apparatus can be simplified.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

First Embodiment

Figure 1:
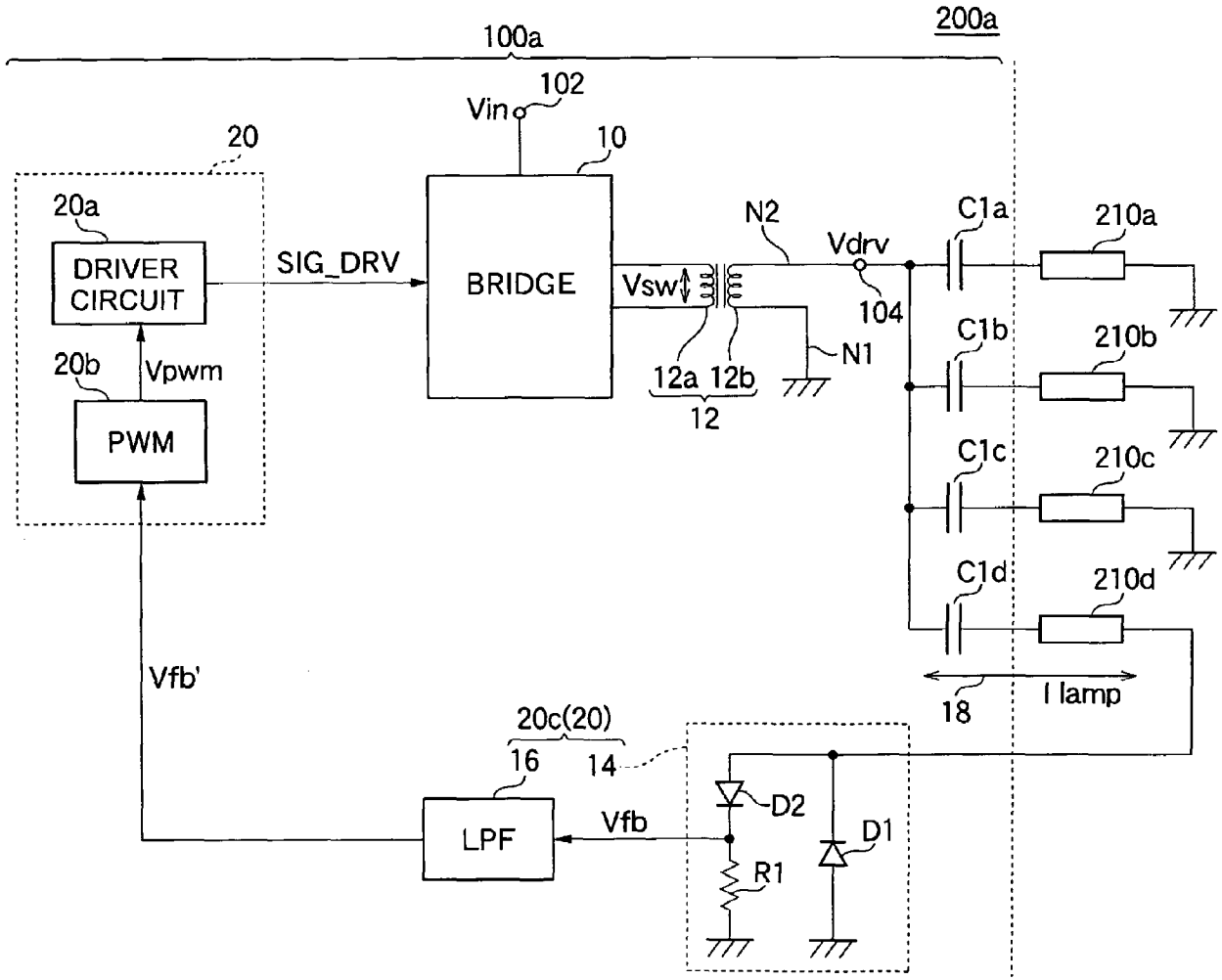
FIG. 1 is a circuit diagram illustrating a construction of a light emitting apparatus according to a first embodiment of the present invention.
Figure 2:
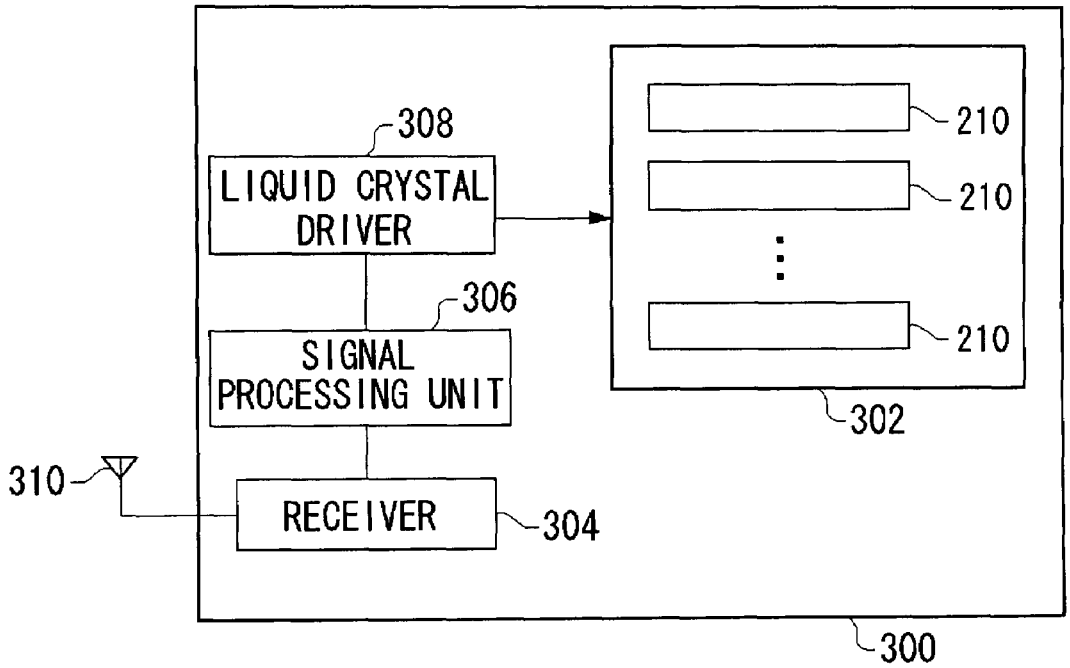
FIG. 2 is a block diagram illustrating a construction of a liquid crystal television provided with the light emitting apparatus of FIG. 1.

FIG. 1 is a circuit diagram illustrating a construction of a light emitting apparatus 200*a* according to a first embodiment of the present invention. FIG. 2 is a block diagram illustrating a construction of a liquid crystal television 300 provided with the light emitting apparatus 200*a* of FIG. 1. Referring to FIG. 2, the liquid crystal television 300 is connected to an antenna 310. The antenna 310 receives a broadcasting wave and outputs a received signal to a receiver 304. The receiver 304 detects and amplifies the received signal and outputs the resulting signal to a signal processing unit 306. The signal processing unit 306 outputs to a liquid crystal driver 308 an image data which can be obtained by demodulating a modulated data. The liquid crystal driver 308 outputs the image data to each scan line of a liquid crystal panel 302, so that an image can be displayed. As a backlight for the liquid crystal panel 302, a plurality of fluorescent lamps 210 are disposed on a rear surface of the liquid crystal panel 302. The light emitting apparatus 200*a* according to the embodiment can be suitably used as the backlight of the liquid crystal panel 302. Now, a construction and operations of the light emitting apparatus 200*a* are described in detail with reference to FIG. 1.

The light emitting apparatus 200 according to the embodiment includes a plurality of fluorescent lamps 210*a*, 210*b*, . . . , 210*d* which are collectively referred to as fluorescent lamps 210 and an inverter 100*a* which supplies an AC driving voltage Vdrv to the fluorescent lamps. Each of the fluorescent lamps 210 may be an EEFL or a CCFL. The fluorescent lamps 210 are disposed on the rear surface of the liquid crystal panel 302. The present invention is not limited by the number of the fluorescent lamps 210, but the number of the fluorescent lamps is determined according to an area of the liquid crystal panel 302.

The inverter 100*a* is a DC/AC converter which converts an input voltage Vin applied to an input terminal 102 to a boosted AC driving voltage Vdrv and supplies the AC driving voltage Vdrv to the fluorescent lamps 210, that is, the loads connected to an output terminal 104.

The inverter 100*a* supplies power to a plurality of the fluorescent lamps 210, for example, the inverter 100*a* generates the AC voltage of 1000V or more to supply the voltage to the fluorescent lamps 210. Since the luminance of the fluorescent lamps 210 is determined according to the currents flowing each of the fluorescent lamps 210, non-uniformity of the driving currents results in an irregularity of luminance of the backlight. Therefore, a plurality of the fluorescent lamps 210 need to be driven uniformly by the inverter 100*a*.

The inverter 100*a* includes a switching circuit 10, a transformer 12, a control circuit 20 (20*a* to 20*c*), and a plurality of capacitors C1*a* to C1*d* which are collectively referred to as capacitors C1.

The transformer 12 includes a primary winding 12*a* and a secondary winding 12*b*. The switching circuit 10 is connected to the primary winding 12*a* of the transformer 12. The switching circuit 10 includes a plurality of transistors (not shown) connected to the primary winding 12*a* of the transformer 12 in a form of an H-bridge circuit or a half bridge circuit. The switching circuit 10 alternately applies an input voltage Vin and a fixed voltage, that is, a ground voltage (0V) lower than the input voltage Vin to the primary winding 12*a* according to the turning-on and turning-off of each transistor. As a result, a switching voltage Vsw is applied to the primary winding 12*a* of the transformer 12. The turning-on and turning-off of each transistor are controlled by a control signal SIG_DRV output from the control circuit 20. One end N1 of the secondary winding 12*b* of the transformer 12 is connected to the ground, and the other end thereof N2 is connected to the output terminal 104.

A plurality of the capacitors C1*a* to C1*d* are provided to a plurality of the fluorescent lamp 210*a* to 210*d* which are loads. The one ends of the capacitors C1*a* to C1*d* are commonly connected to the terminal N2 of the secondary winding 12*b* of the transformer 12. The other ends of the capacitors C1*a* to C1*d* are connected to the corresponding fluorescent lamps 210*a* to 210*d*, respectively. Capacitance value of a plurality of capacitors C1 may be preferably set in a range of 1 pF to 100 pF. Optimal capacitance value can be selected according to impedance of the corresponding fluorescent lamp 210 from the range by using calculation or experiment. The capacitance value of each capacitor C1 is set according to a relative luminance of the fluorescent lamps 210 connected to each capacitor C1. For example, in case of the fluorescent lamps 210 having the same characteristic, when the luminance intends to be uniform, the capacitance values of the capacitors C1 are set to be approximately equal to each other. When the luminance intends to be different among the fluorescent lamps 210, the capacitance values of the capacitors C1 are set to correspond to the desired luminance.

The capacitors C1 may be formed as parts of a chip. Alternatively, in a case where the inverter 100*a* is mounted on a printed circuit board, a part or all of the capacitors C1 may be constructed using patterns formed on a printed circuit board.

The control circuit 20 (20*a* to 20*c*) according to the embodiment monitors a current flowing through a predetermined current path among the entire current paths of the entire circuit including the inverter 100*a* and the fluorescent lamps 210 and performs feedback control of the turning-on and turning-off states of the transistors of the switching circuit 10 to adjust supply of the switching voltage Vsw, that is, a switching power to the primary winding 12*a* of the transformer 12 so that the monitored current is maintained in a predetermined condition.

The control circuit 20 according to the embodiment monitors the current (hereinafter, referred to as a lamp current Ilamp) flowing through the current path 18, as a predetermined current path, including a predetermined load, that is, the fluorescent lamp 210*d* among the fluorescent lamps 210*a* to 210*d*, that is, loads. The control circuit 20 controls the turning-on and turning-off states of a plurality of the transistors of the switching circuit 10 so that the lamp current Ilamp of the fluorescent lamp 210*d* can approach a predetermined current value.

The control circuit 20 includes a driver circuit 20*a*, a pulse width modulator 20*b*, and a feedback circuit 20*c*. For example, the driver circuit 20*a* and the pulse width modulator 20*b* may be integrated together with other analog circuits and digital circuits as a functional IC on one semiconductor substrate. As the functional IC including the driver circuit 20*a* and the pulse width modulator 20*b*, a general circuit designed for an inverter control circuit may be used.

The feedback circuit 20*c* is disposed on the current path including the fluorescent lamp 210*d* to generate a feedback signal Vfb indicating a voltage value corresponding to the lamp current Ilamp. The feedback circuit 20*c* includes a rectifier circuit 14 and a low pass filter 16. The rectifier circuit 14 is disposed on the current path including the fluorescent lamp 210*d* to perform half-wave rectification of the lamp current Ilamp and coverts the lamp current Ilamp to a voltage Vfb. An anode of a first diode D1 of the rectifier circuit 14 is connected to the ground, and a cathode thereof is connected to the fluorescent lamp 210*d*. An anode of a second diode D2 is connected to the cathode of the first diode D1 and the fluorescent lamp 210*d*. A first resistor R1 is connected between the cathode of the second diode D2 and the ground. In the first resistor R1, the half-rectified lamp current Ilamp is flown, so that a voltage drop of Vfb=R1×Ilamp occurs.

The low pass filter 16 removes a high frequency component of the voltage Vfb to output a DC feedback signal Vfb' to a pulse width modulator 20*b*.

The pulse width modulator 20*b* receives the feedback signal Vfb' from the feedback circuit 20*c* and compares the feedback signal Vfb' with a predetermined reference voltage Vref to generate a pulse width modulated signal (hereinafter, referred to as a PWM signal Vpwm). The pulse width modulator 20*b* may be constructed by using a known technology. For example, the pulse width modulator 20*b* may be constructed with an error amplifier and a comparator. The error amplifier amplifies an error between the feedback signal Vfb and the predetermined reference voltage Vref. The comparator compares a period signal Vosc in a triangular or sawtooth waveform with the error signal Verr output from the error amplifier. The comparator outputs the PWM signal Vpwm of which duty ratio, that is, a time ratio of high and low levels is changed according to the result of comparison of the two signals Verr and Vosc.

The driver circuit 20*a* receives the PWM signal Vpwm from the pulse width modulator 20*b*. The driver circuit 20*a* generates the driving signal SIG_DRV for controlling the turning-on and turning-off of the transistors in the switching circuit 10 according to the PWM signal Vpwm, more specifically, according to the high and low levels of the PWM signal Vpwm. The switching voltage Vsw corresponding to the driving signal SIG_DRV is supplied to the primary winding 12*a* of the transformer 12.

Now, operations of the inverter 100*a* as configured above are described.

When the switching circuit 10 supplies the switching voltage Vsw to the primary winding 12*a* of the transformer 12, the AC driving voltage Vdrv corresponding to the duty ratio of the PWM signal Vpwm generated by the pulse width modulator 20*b* and the winding ratio of the transformer 12 occurs at the secondary winding 12*b*.

In the embodiment, a plurality of the fluorescent lamps 210*a* to 210*d* and the capacitors C1*a* to C1*d* connected to the fluorescent lamps 210*a* to 210*d* form a plurality of current paths which are connected in parallel. Since the same driving voltage Vdrv is applied to a plurality of the current paths, a current corresponding to a composite impedance of each capacitor and the load is flown through each current path. Impedances of the capacitors C1 and the fluorescent lamps are complex impedances.

At the time of lighting of the fluorescent lamps 210*a* to 210*d* of which complex impedances are uniform, if the capacitance values of the capacitors C1*a* to C1*d* are equal, almost the same currents are flown through the current path including the capacitor C1*a* and fluorescent lamp 210*a*, the current path including the capacitor C1*b* and fluorescent lamp 210*b*, the current path including the capacitor C1*c* and fluorescent lamp 210*c*, and the current path including the capacitor C1*d* and fluorescent lamp 210*d*.

On the other hand, at the time of lighting of the fluorescent lamps 210*a* to 210*d* of which the complex impedances are not uniform, if the same lamp currents intends to be supplied to the fluorescent lamp 210*a* to 210*d*, the capacitance values of the capacitors C1*a* to C1*d* may be set so as to cancel the differences among the impedances of the fluorescent lamps 210*a* to 210*d*.

In addition, in a case where the impedances of the fluorescent lamps 210*a* to 210*d* are uniform, if the capacitance values of the capacitors C1*a* to C1*d* are set to be different values, the lamp currents flowing through the fluorescent lamps 210*a* to 210*d*, that is, the luminance thereof can be purposefully set to be different values.

As described above, the control circuit 20 generates the PWM signal Vpwm so that the lamp current Ilamp flowing through the current path 18 including the capacitor C1*d* and the fluorescent lamp 210*i* can approach a desired current value. Therefore, according to the inverter 100*a* of the embodiment, the current flowing through the fluorescent lamp 210*d* can be controlled in a feedback manner so as to approach the predetermined current value. In addition, since a current corresponding to the composite impedance of the current path including each of the fluorescent lamps 210*a* to 210*c* is flown through each of the fluorescent lamps 210*a* to 210*c*, the current can be indirectly controlled by adjusting the capacitance values of the capacitors C1.

In the inverter 100*a* according to the embodiment, a plurality of the fluorescent lamps 210 can be suitably lighted with desired luminance by using one control circuit 20. As a result, it is possible to reduce mounting area, cost, and power consumption in comparison with a case of stabilizing the lamp currents with interconnections for connecting the feedback circuit 20*c* or blocks provided to each of the fluorescent lamps 210.

In addition, the capacitance values of the capacitors C1 that are set in a range of 1 pF to 100 pF are directly inserted into the fluorescent lamps 210. Therefore, although the impedance of the fluorescent lamps 210*a* to 210*d* and the parasite capacitances and resistances of peripheral circuits are not uniformly varied, the capacitors C1 can cancel the non-uniformity of the impedances, so that the lamp currents flowing through the fluorescent lamps 210 can be maintained in a constant value. Accordingly, the luminance of the fluorescent lamps can be stabilized.

For example, since there are parasite capacitances at the terminals of the fluorescent lamps 210 or between interconnection patterns in a practical inverter 100*a*, if the capacitors C1 are not provided or if the capacitance values thereof is too low, the parasite capacitances affect the impedances of the current paths including the fluorescent lamps 210, so that the luminance thereof is influenced. However, according to the embodiment, the capacitors C1 having suitable capacitance values are provided, so that the influence of the parasite capacitances can be reduced. Accordingly, the lamp current can be stabilized. In addition, the frequency characteristic of the complex impedances of the fluorescent lamps 210 and the frequency characteristic of the complex impedances of the capacitors C1 has an inverse characteristic relation. Therefore, by directly connecting the capacitors C1 and the fluorescent lamps 210, the composite impedances of the capacitors C1 and the fluorescent lamps 210 can be flattened. As a result, the luminance of the fluorescent lamps 210 can be maintained to be constant values in a wide frequency range.

Second Embodiment

Figure 3:
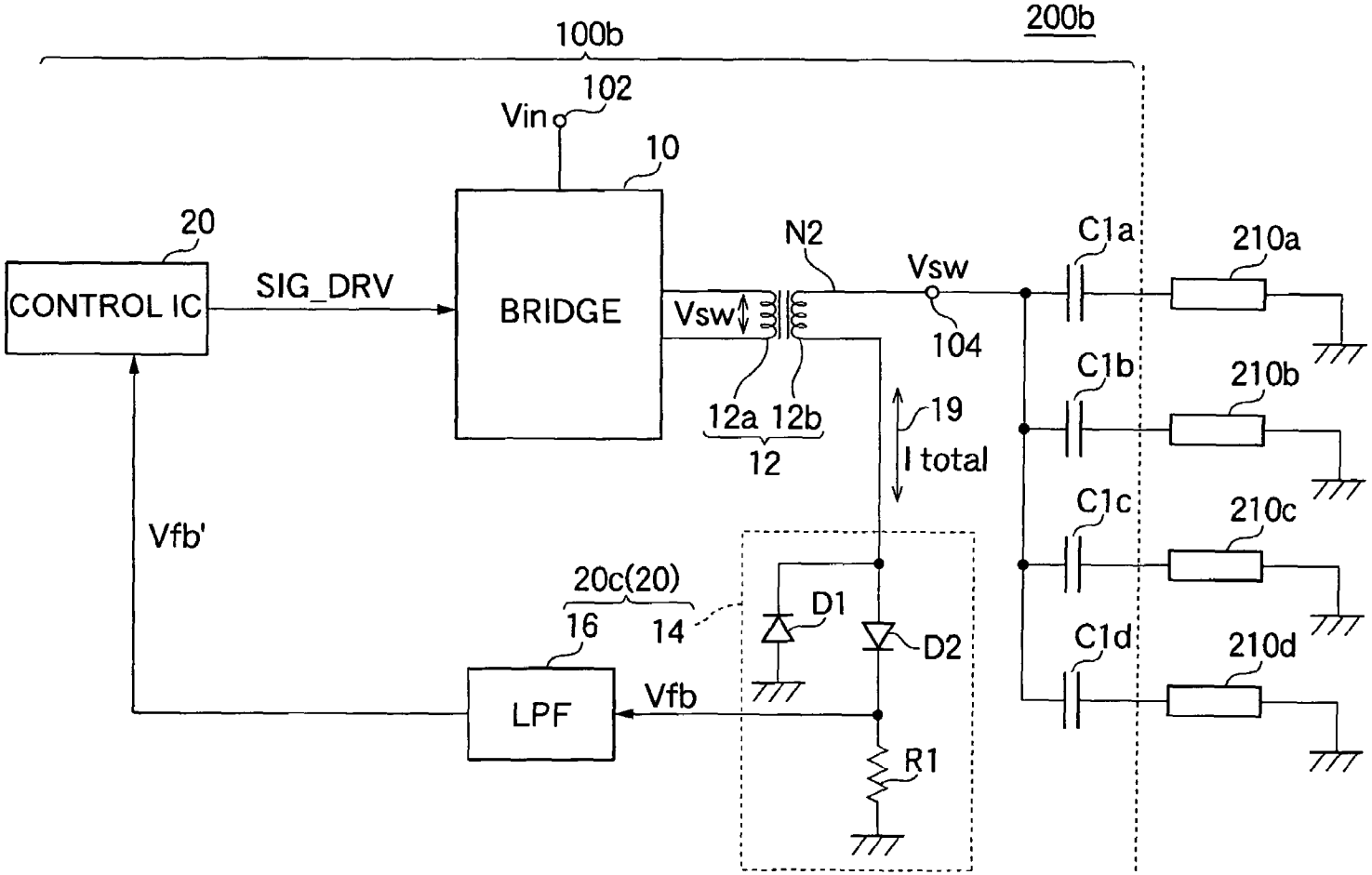
FIG. 3 is a circuit diagram illustrating a construction of a light emitting apparatus according to a second embodiment.

FIG. 3 is a circuit diagram illustrating a construction of a light emitting apparatus 200*b* according to a second embodiment. Now, the construction and operations of an inverter 100*b* are described in terms of difference to the inverter 100*a* according to the first embodiment.

The inverter 100*b* according to the embodiment is different from the inverter 100*a* according to the first embodiment in terms of a current path which is monitored by the control circuit 20. More specifically, in the inverter 100*a* according to the first embodiment, the current flowing through the current path including the predetermined load is monitored. However, in the inverter 100*a* according to the embodiment, the current flowing through a current path 19 including the secondary winding 12*b* of the transformer 12 is monitored.

In the inverter 100*b* shown in FIG. 3, the feedback circuit 20*c* is provided on the current path 19 including the secondary winding 12*b* of the transformer 12 to generate the feedback signal Vfb indicating the voltage value corresponding to a current Itotal flowing the current path 19. Referring to FIG. 3, the control circuit 20 includes the driver circuit 20*a* and the pulse width modulator 20*b* of FIG. 1. The control circuit 20 controls the turning-on and turning-off states of a plurality of the transistors included in the switching circuit 10 so that the current Itotal flowing the secondary winding 12*b* of the transformer 12 can approach a predetermined current value.

The current Itotal flowing the secondary winding 12*b* is output through the output terminal 104 and branched into the current paths including the respective capacitors C1 and fluorescent lamps 210. The currents branched into the current paths are determined according to the composite impedances of the respective current paths. For example, in a case where the composite impedances of the current paths are equal to each other, the current Itotal is distributed uniformly over the current paths, so that the luminance of the fluorescent lamps 210*a* to 210*d* can be uniform. On the other hand, in a case where the composite impedances of the current paths are purposefully set to be different from each other, the luminance of the fluorescent lamps 210*a* to 210*d* can be different from each other.

According to the second embodiment, the feedback control is performed so that the total current flowing through a plurality of the fluorescent lamps 210*a* to 210*d*, that is, loads can be maintained to be a constant value, so that the lamp currents flowing through the fluorescent lamps 210*a* to 210*d* can be controlled.

Third Embodiment

Figure 4:
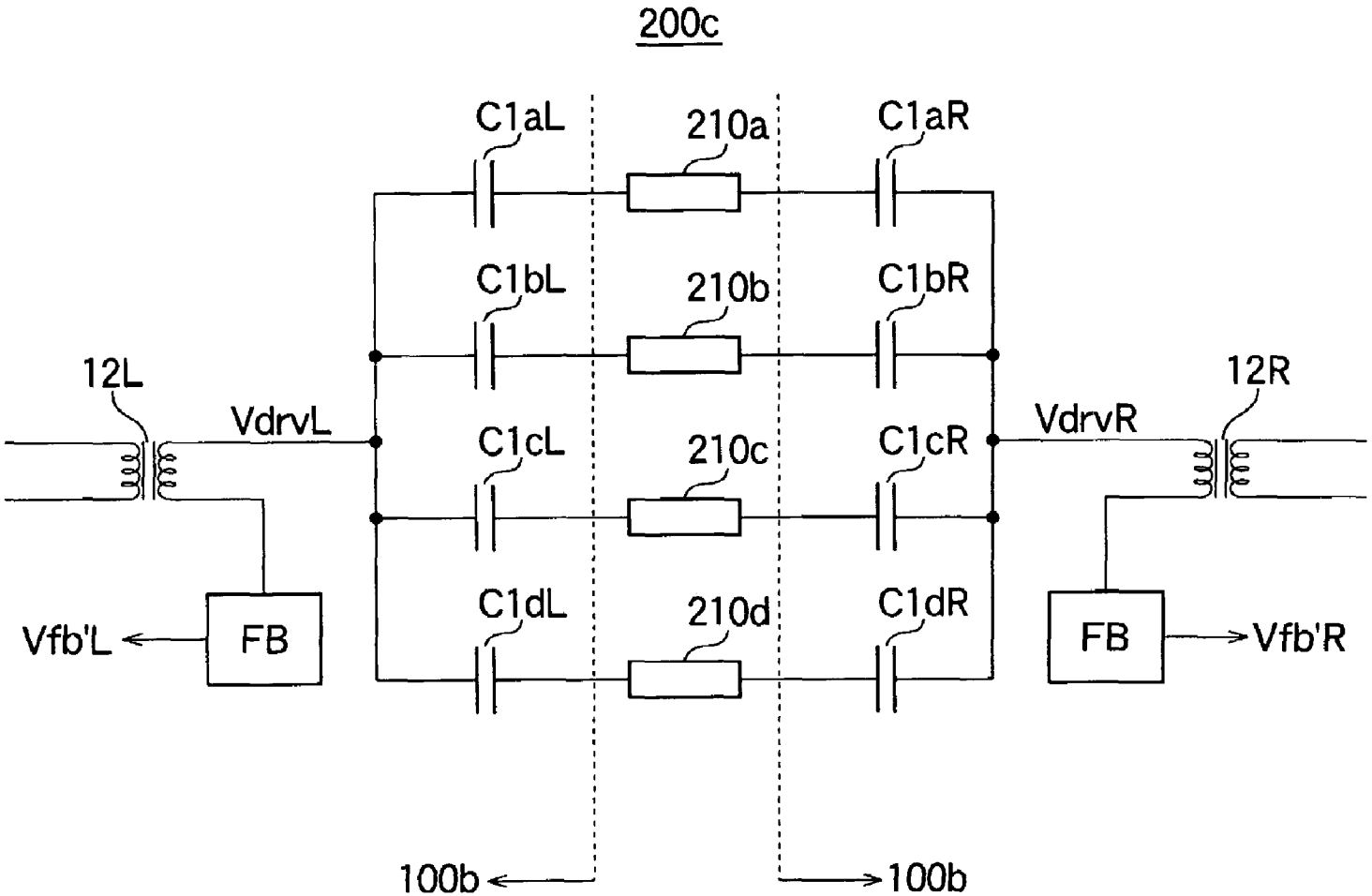
FIG. 4 is a circuit diagram illustrating a part of a construction of a light emitting apparatus according a third embodiment.

An inverter 100*c* according to a third embodiment is an application of the inverter 100*b* according to the second embodiment. FIG. 4 is a circuit diagram illustrating a part of a construction of a light emitting apparatus 200*c* according to the third embodiment.

As shown in FIG. 4, the light emitting apparatus 200*c* include two inverters 100*b*. Each of the inverters 100*b* has the same construction as that of the inverter 100*b* according to the second embodiment shown in FIG. 3. The two inverters 100*b*, that is, inverters 100*b*R and 100*b*L are provided to both sides of the fluorescent lamps 210*a* to 210*d*. The inverters 100*b*R and 100*b*L drive the loads so that the currents flowing through the secondary windings of the transformers 12R and 12L are constant values. The driving voltage VdrvR of the inverter 100*b*R and the driving voltage VdrvL of the inverter 100*b*L are inverted AC voltages.

According to the embodiment, a plurality of the fluorescent lamps 210 can be driven by the two inverters.

It can be understood by the skilled in the art that the embodiment is exemplary and various modifications can be made by combination of aforementioned components and processes without departing from the scope of the present invention.

Although the current flowing the current path including the predetermined load or the secondary winding 12*b* of the transformer 12 is monitored in the aforementioned embodiments, the present invention is not limited thereto. For example, the current flowing through the primary winding 12*a* of the transformer 12 or the current flowing through the transistor included in the switching circuit 10 may be monitored.

In addition, the present invention is limited to the driving scheme for the fluorescent lamps according to the embodiments. A plurality of the fluorescent lamps 210 can be driven by using a known technology. In particularly, the present invention can be employed without limitation to a topological construction.

In addition, the load driven by the inverter 100*a* according to the embodiment is not limited to the fluorescent tube. Various devices requiring a high AC voltage may be applied as the load.

In the embodiment, settings of logic values, that is, the high and low levels of the logic circuits are exemplary ones. Therefore, various settings of logic values can be made by suitable inversion using an inverter or the like.

While the preferred embodiments of the present invention have been described using specific terms, such description is for illustrative purposes only, and it is to be understood that changes and variations may be made without departing from the spirit or scope of the appended claims.

What is claimed is:

1. An inverter apparatus for converting an input voltage to an AC driving voltage and supplying the AC driving voltage to a plurality of loads, comprising:

a transformer including a primary winding and a secondary winding;

a switching circuit including a plurality of transistors connected to the primary winding of the transformer, the switching circuit alternately applying the input voltage and a fixed voltage lower than the input voltage to the primary winding of the transformer according to turning-on and turning-off of each of the transistors;

a plurality of capacitors provided to the respective loads, one ends of the capacitors being commonly connected to the secondary winding of the transformer, and the other ends thereof being connected to the respective loads; and a control circuit structured to monitor a current flowing through the plurality of loads, and structured to perform feedback control of the turning-on and turning-off states of a plurality of the transistors of the switching circuit to adjust supply of switching power to the primary winding of the transformer, wherein:

the plurality of loads comprises:

a first load having one end thereof connected to one of the plurality of capacitors and the other end connected to the control circuit; and a plurality of second loads each having one end thereof connected to one of the plurality of capacitors and the other end thereof connected to the ground;

wherein the control circuit monitors a current flowing in the first load of the plurality of loads.

2. The inverter apparatus according to claim 1, wherein the plurality of the loads is a plurality of fluorescent lamps.

3. The inverter apparatus according to claim 2, wherein capacitance values of the plurality of the capacitors are set to be in a range of 1 pF to 100 pF.

4. The inverter apparatus according to claim 2, wherein capacitance values of the plurality of the capacitors are set according to relative luminance among the plurality of the fluorescent lamps.

5. The inverter apparatus according to claim 1, wherein at least a part of the plurality of the capacitors is constructed as patterns formed on a printed circuit board where the inverter apparatus is mounted.

6. The inverter apparatus according to claim 1, wherein the control circuit monitors a current flowing through the current paths including a predetermined load among the plurality of the loads and controls the turning-on and turning-off states of the plurality of the transistors of the switching circuit so that the current flowing through the predetermined load approaches a predetermined current value.

7. The inverter apparatus according to claim 6, wherein the control circuit comprises:

a feedback circuit which is disposed on the current path including the predetermined load to generate a feedback signal indicating a voltage value corresponding to the current flowing through the predetermined load;

a pulse modulator which receives the feedback signal from the feedback circuit and compares the feedback signal with a predetermined reference voltage to generate a pulse modulated signal; and a driver circuit which receives the pulse modulated signal from the pulse modulator and controls the turning-on and turning-off of the plurality of the transistors of the switching circuit based on the pulse modulated signal.

8. The inverter apparatus according to claim 1, wherein the control circuit monitors a current flowing through a current path including the secondary winding of the transformer and controls the turning-on and turning-off states of the plurality of the transistors of the switching circuit so that the current flowing through the secondary winding of the transformer can approach a predetermined current value.

9. The inverter apparatus according to claim 1, wherein the control circuit comprises:

a feedback circuit which is disposed on the current path including the secondary winding of the transformer to generate a feedback signal indicating a voltage value corresponding to the current flowing through the secondary winding of the transformer;

a pulse modulator which receives the feedback signal from the feedback circuit and compares the feedback signal with a predetermined reference voltage to generate a pulse modulated signal; and a driver circuit which receives the pulse modulated signal from the pulse modulator and controls the turning-on and turning-off of the plurality of the transistors of the switching circuit based on the pulse modulated signal.

10. A light emitting apparatus comprising:

a plurality of fluorescent lamps; and the inverter apparatus according to claim 1, which supplies AC driving voltages to the plurality of the fluorescent lamps that are the loads.

11. The light emitting apparatus according to claim 10, wherein the fluorescent lamps are cold cathode tube fluorescent lamps.

12. The light emitting apparatus according to claim 10, wherein the fluorescent lamps are external electrode fluorescent lamps.

13. An image display apparatus comprising:

a liquid crystal panel; and the light emitting apparatus according to claim 10 which is disposed as a backlight on a rear surface of the liquid crystal panel.

* * * * *